US007389796B2

(12) United States Patent
Vilhelmsen

(10) Patent No.: US 7,389,796 B2
(45) Date of Patent: Jun. 24, 2008

(54) HIDDEN FAUCET

(75) Inventor: Ejvind Vilhelmsen, Lagneskov (DK)

(73) Assignee: Masco Corporation of Indiana, Indianapolis, IN (US)

( * ) Notice: Subject to any disclaimer, the term of this patent is extended or adjusted under 35 U.S.C. 154(b) by 256 days.

(21) Appl. No.: 11/056,720

(22) Filed: Feb. 11, 2005

(65) Prior Publication Data

US 2005/0178452 A1 Aug. 18, 2005

Related U.S. Application Data

(63) Continuation of application No. PCT/DK2005/000038, filed on Jan. 21, 2005.

(30) Foreign Application Priority Data

Feb. 13, 2004 (DK) ..... 2004 00224

(51) Int. Cl.
*B67D 5/37* (2006.01)

(52) U.S. Cl. ..... 137/801; 137/616.5; 4/677; 4/678

(58) Field of Classification Search ..... 137/801, 137/616, 616.5; 239/203–204, 284.1, 284.2, 239/17, 19, 201–202; 92/136; 74/89.17, 74/89.21; 4/675–678, 567–568, 443–446, 4/420.1–420.5, 615

See application file for complete search history.

(56) References Cited

U.S. PATENT DOCUMENTS 1,122,111 A * 12/1914 Hanson ..... 417/441
2,255,095 A * 9/1941 Baker et al. ..... 417/24
2,903,710 A 9/1959 Pearson
2,997,722 A 8/1961 Pearson
3,620,272 A * 11/1971 Eriksson et al. ..... 144/4.1
3,680,780 A 8/1972 Arbon
4,457,342 A 7/1984 Moen
4,629,157 A * 12/1986 Tsuchiya et al. ..... 251/96
5,269,464 A * 12/1993 Epple et al. ..... 239/130
6,273,138 B1 * 8/2001 Yoney ..... 137/801
6,438,789 B1 * 8/2002 Murawa et al. ..... 15/250.01
6,668,393 B1 12/2003 Mascari et al.
6,754,912 B1 * 6/2004 Hayashi et al. ..... 4/420.2
6,854,666 B2 * 2/2005 Jenkins ..... 239/284.2
7,108,011 B1 9/2006 Lordahl et al.
7,296,758 B2 11/2007 Zhou
2002/0040500 A1 4/2002 Noguchi et al.
2006/0124669 A1 * 6/2006 Wempe et al. ..... 222/192
2007/0175530 A1 8/2007 Vilhelmsen

FOREIGN PATENT DOCUMENTS

| | | | |
|---|---|---|---|
| BE | 847067 | | 1/1977 |
| EP | 0 076 717 | | 4/1983 |
| FR | 1087901 | | 3/1955 |
| JP | WO00/43602 | * | 7/2000 |

OTHER PUBLICATIONS

International Preliminary Examination Report dated May 12, 2006, International Application No. PCT/DK2005/000038.

* cited by examiner

*Primary Examiner*—Ramesh Krishnamurthy
*Assistant Examiner*—Craig M Schneider
(74) *Attorney, Agent, or Firm*—Baker & Daniels

(57) ABSTRACT

A faucet with a vertically adjustable spout.

35 Claims, 11 Drawing Sheets

HIDDEN FAUCET

CROSS-REFERENCE TO RELATED APPLICATION

This application claims the benefit of Danish Patent Application No. 2004 00224, filed Feb. 13, 2004, and is a continuation of PCT Patent Application No. PCT/DK2005/000038, filed Jan. 21, 2005, both of which are hereby expressly incorporated by reference.

BACKGROUND AND SUMMARY OF THE INVENTION

The invention relates to a faucet or mixer tap with a vertically movable spout and a separate control input or adjusting means.

According to an illustrative embodiment of the invention a faucet includes a spout that can be moved upwards and downwards by means of a hydraulic cylinder. The faucet is particularly discrete, and the spout may be moved downwards to a lowered or hidden position substantially flush with the support deck or table top. The faucet may further be adapted such that the water supply to the spout is not opened until the spout is in its uppermost or raised position. The upward and downward movement of the spout may be controlled by the pressure from the water supply. In an alternative embodiment, the upward movement of the spout may be activated by depressing the end of the spout to release a snap lock.

According to yet another illustrative embodiment, the downward movement of the piston rod may be activated by depressing and keeping the control input down until the piston rod and the spout have adopted their lowered positions.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

In the following description and accompanying drawings, all fluid control valves are shown in their neutral positions, in other words with no input applied to their respective control inlets. Additionally, common reference numbers are used to identify common components throughout the various drawings.

Figure 1A:
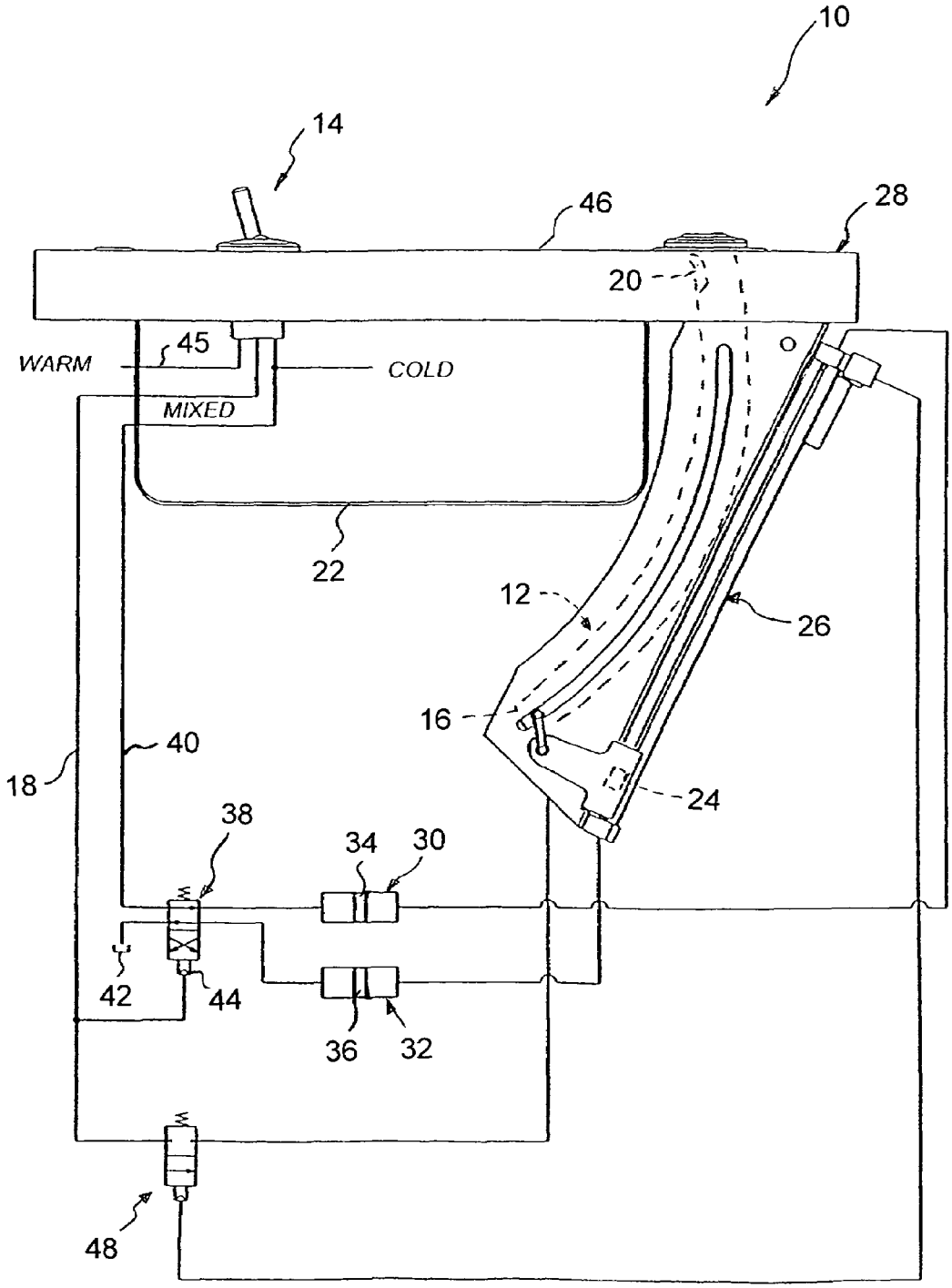
FIG. 1A is a side elevational view, in partial schematic, of an illustrative embodiment faucet showing the spout in a lowered position, wherein the upward and downward movement of the spout is controlled by the on/off function of the control input.
Figure 1B:
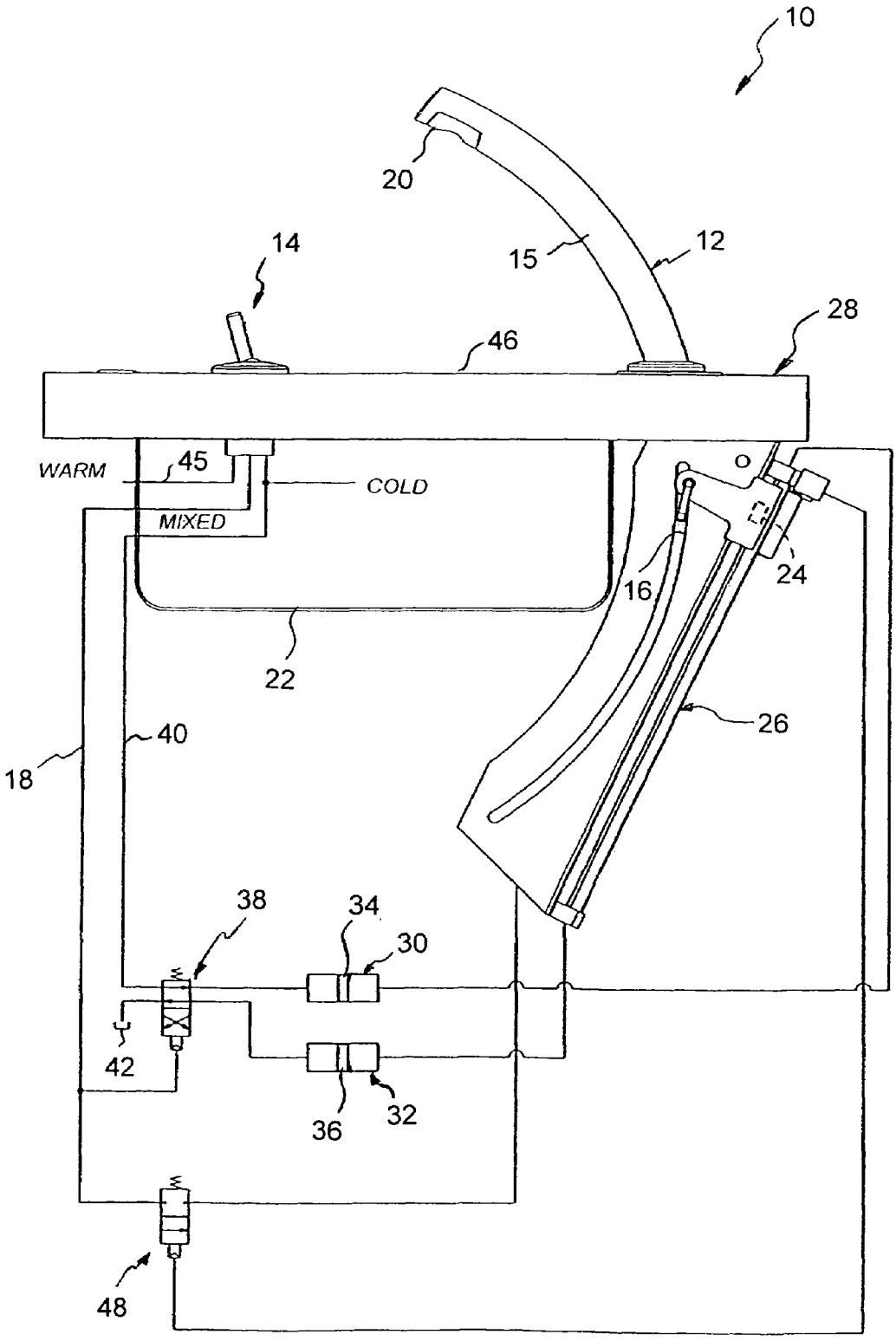
FIG. 1B is a view similar to FIG. 1A showing the spout in a raised position.

Referring initially to FIGS. 1A and 1B, an illustrative embodiment mixer tap or faucet 10 includes a vertically adjustable delivery spout 12 and an adjusting means or control input 14 in distance therefrom. The spout 12 includes a tubular body 15 having an inlet 16 coupled to a mixed water supply 18 and an outlet 20 configured to supply water, illustratively to a sink or basin 22. The spout 12 is upwardly and downwardly movable by means of an actuator, illustratively a piston rod 24 of a hydraulic cylinder 26 arranged under a table top or sink support deck 28. The upward movement of the piston rod 24 is controlled by an oil pressure applied from below, while the downward movement of the piston rod 24 is controlled by an oil pressure applied from above. The two oil pressures originate from oil containers 30, 32 containing displaceable pistons 34, 36, water being provided on a first side (left side in FIGS. 1A and 1B) of the piston 34, 36 and oil being provided on the other or second side thereof (right side in FIGS. 1A and 1B). Water pressure on the first side of the piston 34, 36 is thus converted into an oil pressure on the second side of the piston 34, 36. Via a change-over valve 38, the two oil containers 30, 32 communicate with a cold water supply 40 and a drain 42, respectively. The control inlet 44 of the change-over valve 38 communicates with the mixed water supply 18, the temperature thereof being adjusted by means of the control input 14. The control input 14 mixes water from a warm water supply 45 and the cold water supply 40 and then supplies mixed water to the mixed water supply 18 upon user activation, all in a manner known in the art.

Referring further to FIG. 1A, in operation the spout 12 of the faucet 10 is initially retained in its lowered or hidden position by the pressure from the cold water supply 40 being fed to the oil container 30 via the change-over valve 38. As described above, the oil container 30 converts the water pressure from the cold water supply 40 into an oil pressure lowering the spout 12. As shown in FIG. 1A, in the lowered position the outlet 20 of the spout 12 is illustratively supported below an upper surface 46 of the support deck 28. As the control input 14 for the mixed water supply 18 is turned on, the resulting pressure acts on the control inlet 44 of the change-over valve 38. As a result, the change-over valve 38 changes its position such that the cold water pressure instead is applied to the other oil container 32 which then applies an oil pressure for raising the spout 12. When the spout 12 is in its uppermost or raised position as shown in FIG. 1B, an additional change-over valve 48 is activated and turns on the supply of mixed water to the spout 12. When in its raised position, the outlet 20 of the spout 12 is positioned above the upper surface 46 of the support deck 28 for delivering water to the sink 22.

When the water is turned off through control input 14, the reverse action takes place. The pressure applied by the mixed water supply 18 to the first change-over valve 38 decreases and the change-over valve 38 changes position. Pressure from the cold water supply 40 is then applied to oil container 30 which, in turn, applies an oil pressure for lowering the spout 12. More particularly, the oil pressure applied to the lowermost portion of the cylinder 26 decreases, and increased oil pressure instead being applied to the uppermost portion of the cylinder 26. As a result, the piston rod 24 lowers the spout 12 and the change-over valve 48 disconnects the water supply to the spout 12.

Figure 2:
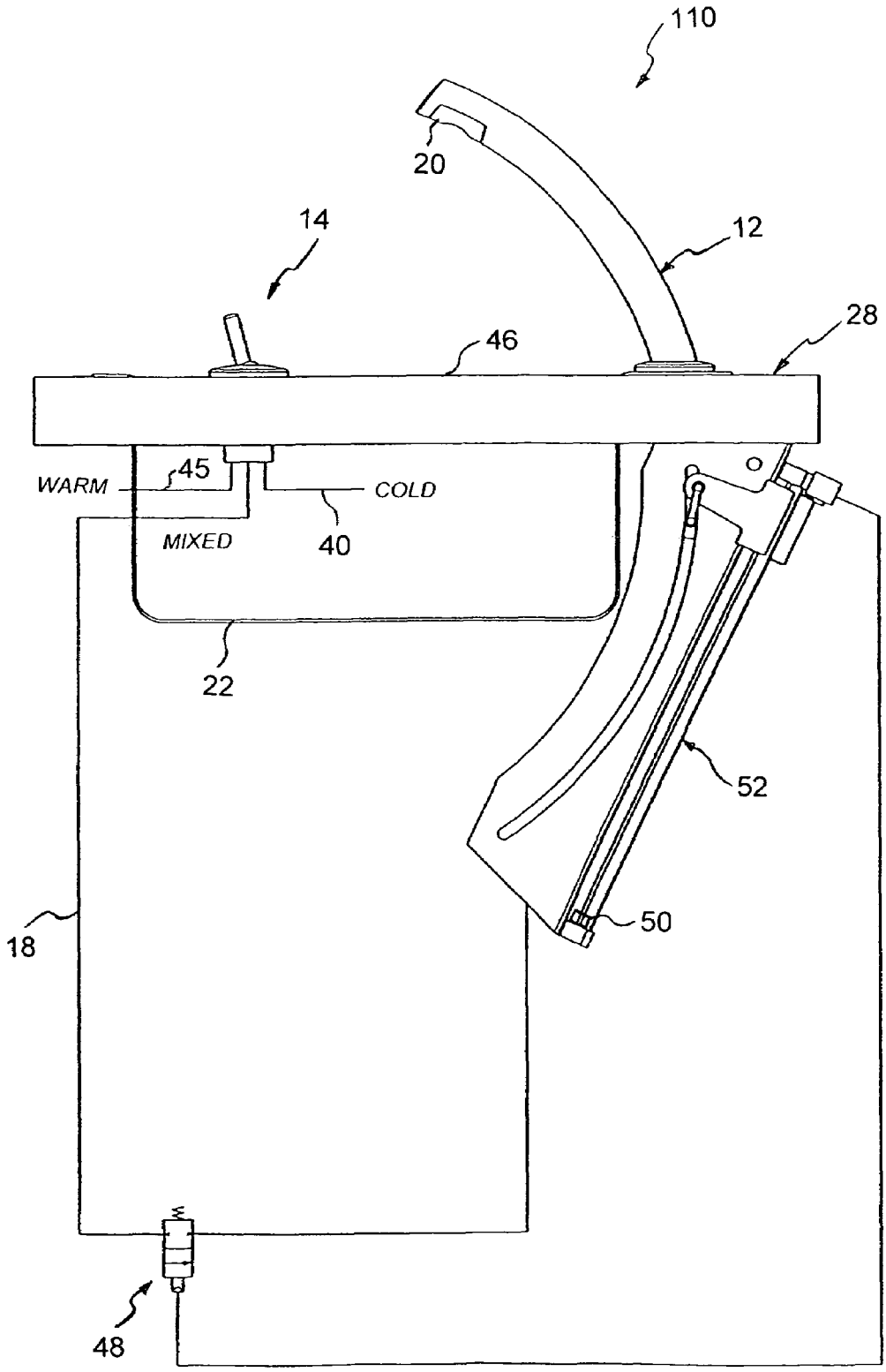
FIG. 2 is a side elevational view, in partial schematic, of a further illustrative embodiment faucet, wherein the upward and downward movement of the spout is activated by depressing the end of the spout.

In the further illustrative embodiment faucet 110 shown in FIG. 2, the upward and downward movements of the spout 12 are performed manually. More particularly, the upward movement of the spout 12 is activated the depressing the upper end of the spout 12 to release a snap lock 50, whereby an actuator, illustratively a spring or a gas cylinder 52, moves the spout 12 to its raised position. When the spout 12 has adopted its raised position, the additional change-over valve 48 is activated, the valve 48 turning on the mixed water supply 18 to the spout 12. The reverse movement of the spout 12 is effected by depressing the upper end thereof until it is locked by the snap lock 50 in its lowered or hidden position.

Figure 3:
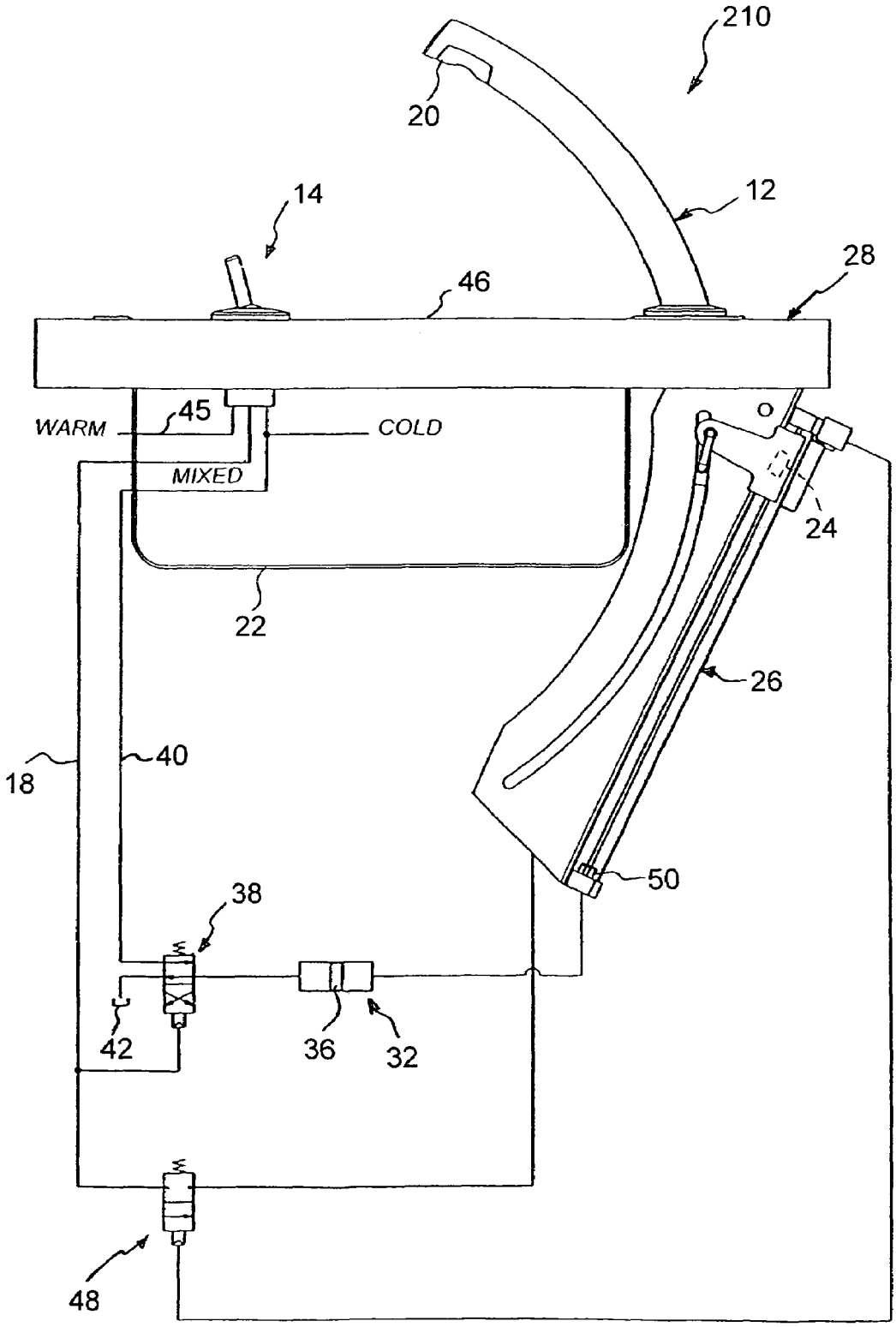
FIG. 3 is a side elevational view, in partial schematic, of a further illustrative embodiment faucet, wherein the upward movement of the spout is activated when the water is turned on, while the downward movement is effected by depressing the end of the spout.

As the faucet shown in FIGS. 1A and 1B, the further illustrative embodiment faucet 210 shown in FIG. 3 includes a cylinder 26 with a piston rod 24 for moving the spout 12. Via an oil container 32, having a displaceable piston 36 for converting water pressure to oil pressure, and a change-over valve 38, the lowermost portion of the cylinder 26 communicates with pressure from the cold water supply 40. The change-over valve 38 is controlled by the pressure of the mixed water supply 18.

Operation of the faucet 210 shown in FIG. 3 begins by assuming that the spout 12 is in its lowered position. When the mixed water supply 18 is turned on at the control input 14, the first change-over valve 38 is activated and thus changes position such that an oil pressure is applied to the hydraulic cylinder 26 which, in turn, moves the spout 12 upwards. When the spout 12 is completely raised, the spout 12 is supplied with mixed water via an additional change-over valve 48. When the mixed water supply 18 has been turned off at the control input 14, the reverse movement of the spout 12 is effected by manually depressing the upper end of the spout 12. Additionally, the supply of mixed water to the spout 12 is cut off due to the removal of pressure to the lowermost change-over valve 48. When the spout 12 has returned to its hidden or lowered position, the spout 12 is locked by means of snap lock 50.

Figure 4A:
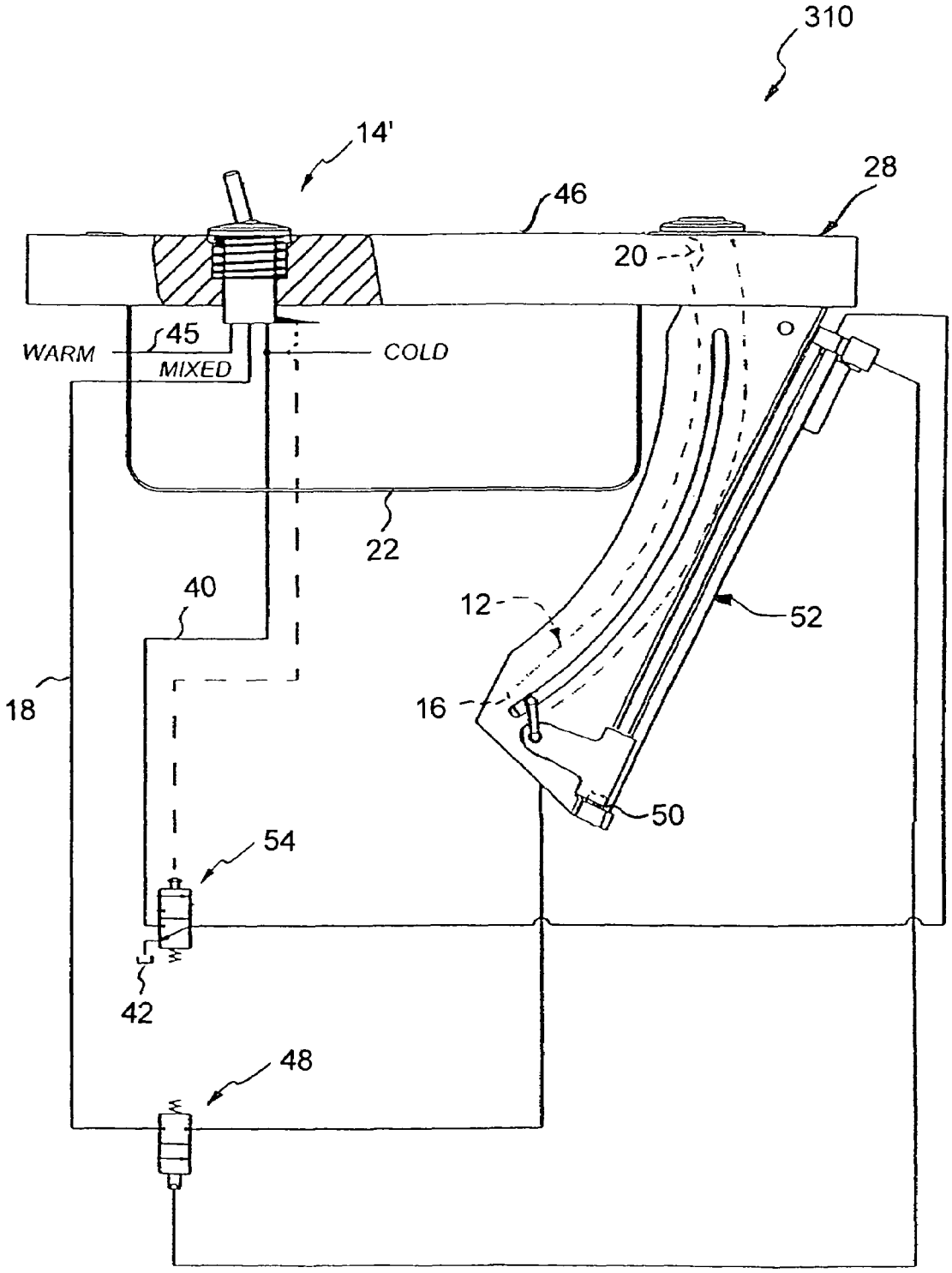
FIG. 4A is a side elevational view, in partial schematic, of a further illustrative embodiment faucet showing the spout in a lowered position, wherein the upward movement of the spout is activated by depressing the end of the spout, while the downward movement is activated by depressing the control input and keeping it down until the spout has adopted a hidden position.
Figure 4B:
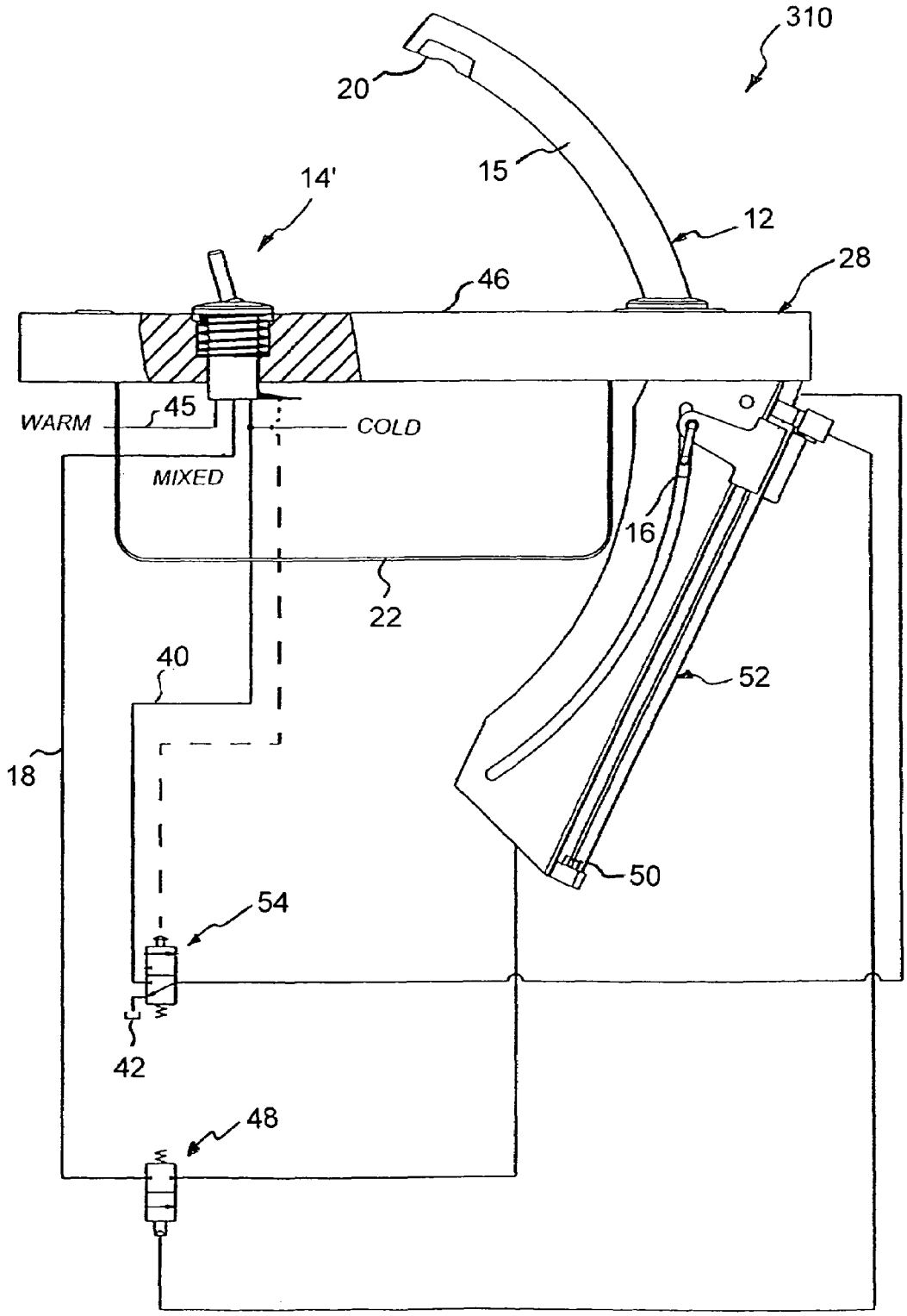
FIG. 4B is a view similar to FIG. 4A showing the spout in a raised position.

As with the embodiment shown in FIGS. 1A and 1B, the further illustrative embodiment faucet 310 shown in FIGS. 4A and 4B includes a vertically adjustable spout 12 and an adjusting means or control input 14' spaced apart from the spout 12. In the embodiment shown in FIGS. 4A and 4B, the adjusting means 14' may be depressed, the depression thereof acting on a slide valve 54 controlling the communication of pressure from the cold water supply 40 to the uppermost portion of the hydraulic cylinder 16. Referring further to FIG. 4A, in operation the spout 12 of the faucet 310 is initially retained in its lowered position by snap lock 50. The upward movement of the spout 12 is activated by depressing the upper end of the spout 12 and thereby releasing the snap lock 50, subsequent to which an actuator, illustratively a spring or gas cylinder 52, moves the spout 12 into the raised position. The reverse movement is obtained by depressing the adjusting means 14' and keeping it depressed until the spout 12 has adopted its hidden or lowered position and is locked by the snap lock 50. As with the embodiment shown in FIGS. 1A and 1B, there is provided a slide valve 48 ensuring that water is only supplied to the spout 12 in its raised position.

Figure 5A:
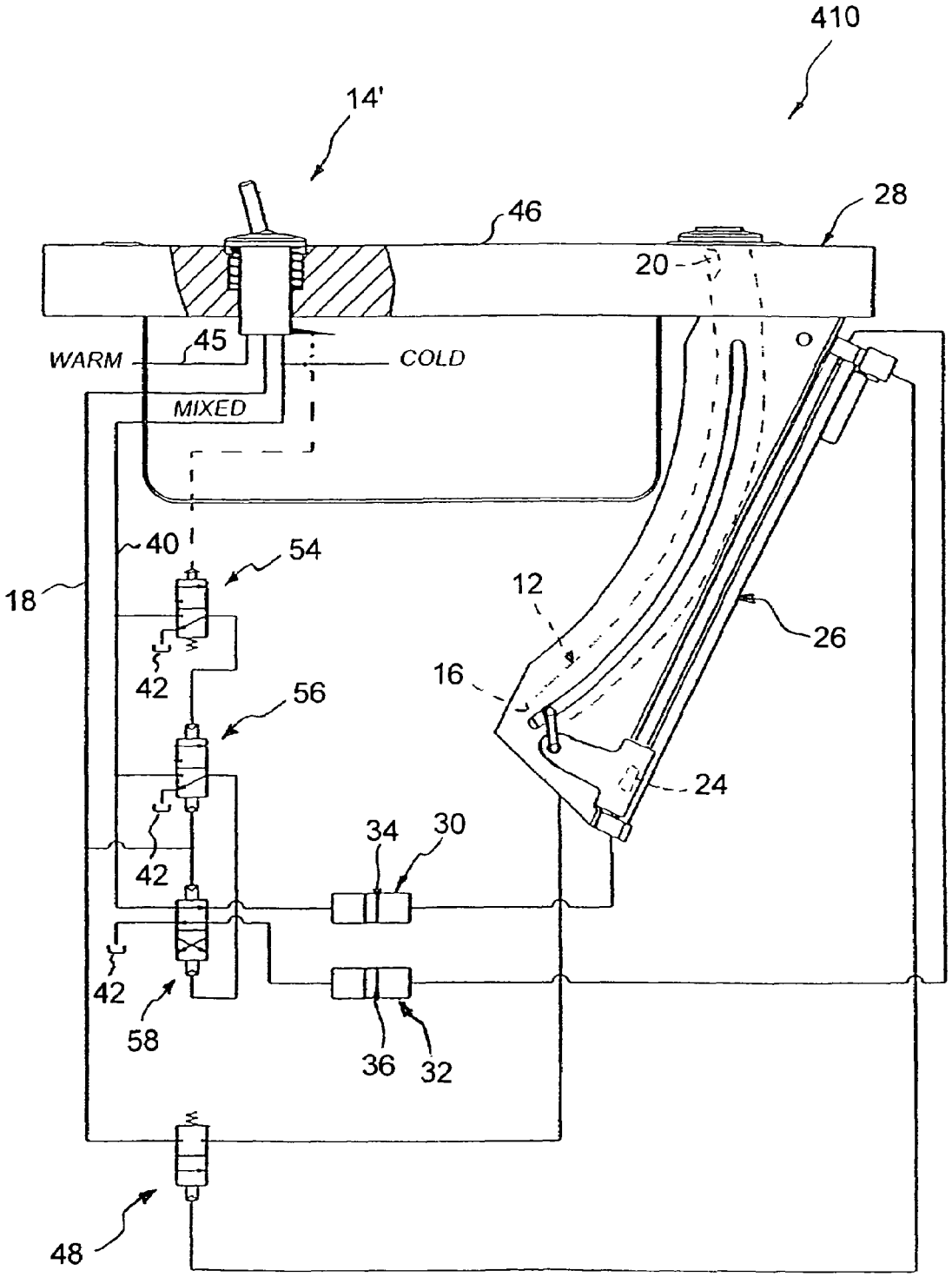
FIG. 5A is a side elevational view, in partial schematic, of a further illustrative embodiment faucet showing the spout in a lowered position, wherein the upward movement of the spout is activated when the water is turned on, while a downward movement is activated by momentarily depressing the control input.
Figure 5B:
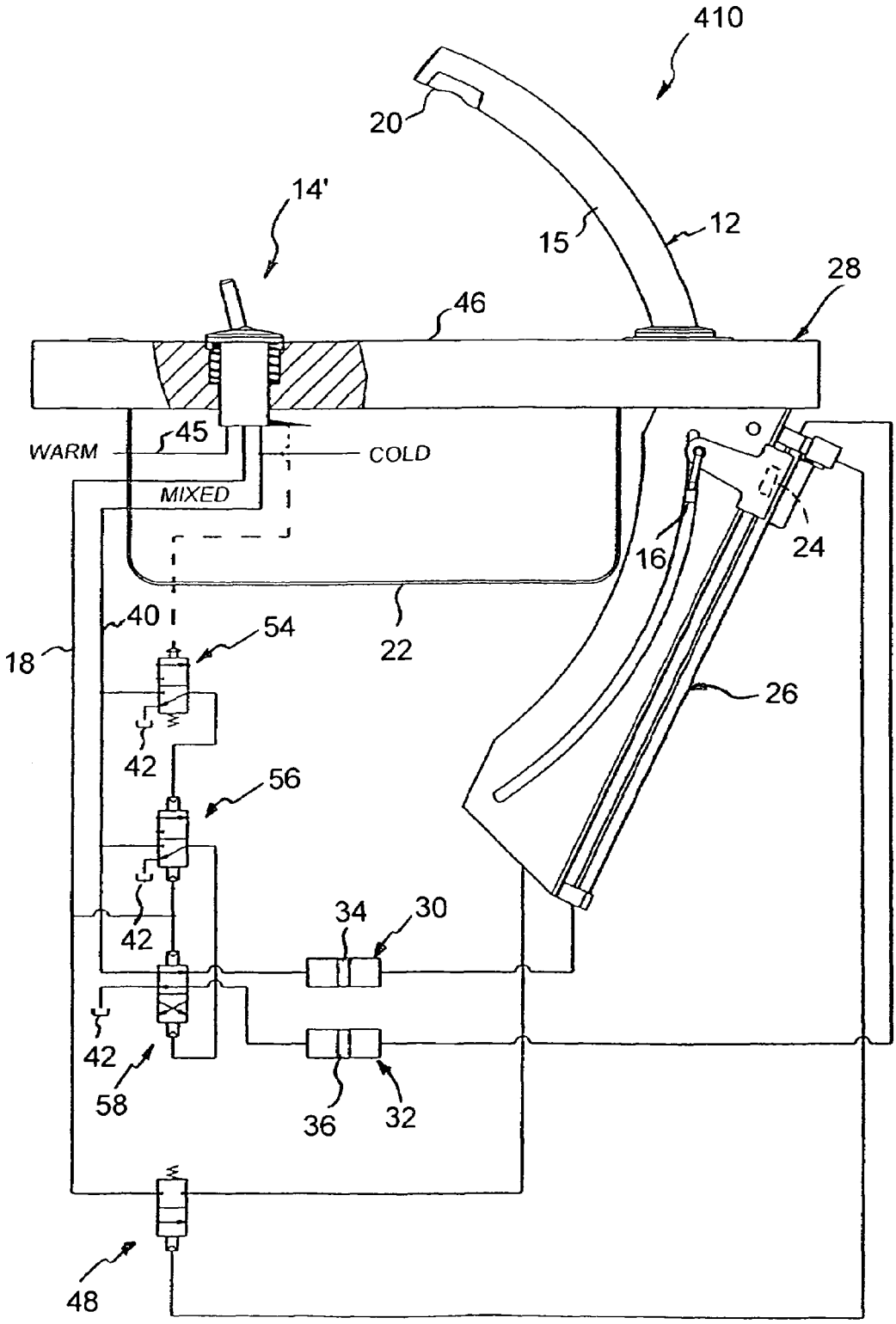
FIG. 5B is a view similar to FIG. 5A showing the spout in a raised position.

As the embodiment shown in FIGS. 4A and 4B, the embodiment of the faucet 410 shown in FIGS. 5A and 5B is provided with an adjusting means or control input 14', which can be depressed for activating a slide valve 54. The upward and simultaneous forward movement of the spout 12 is activated by turning on the mixed water supply 18 at the adjusting means 14'. The pressure from the mixed water supply 18 thereby activates a slide valve 56 causing the pressure from the cold water supply 40 to force the piston 24 of the hydraulic cylinder 26 and thus spout 12 upwards via an additional change-over valve 58.

As in the above embodiments, the mixed water supply 18 to the spout 12 is not turned on until the spout 12 has adopted its uppermost or raised position. The reverse movement of the spout 12 is activated by momentarily depressing the control input 14', whereby the associated slide valve 54 ensures that the pressure from the cold water supply 40 decreases momentarily and acts on the subjacent change-over valve 56 which thus is displaced downwardly in the embodiment shown in FIGS. 5A and 5B. Such movement of the valve 56 causes the pressure from the cold water supply 40 to momentarily move the third slide valve 58 in an upward direction, as shown in FIGS. 5A and 5B, such that oil pressure is applied by the oil container 32 to the uppermost portion of the cylinder 26, whereby the piston 24 and thus the associated spout 12 are forced downwards.

Figure 6:
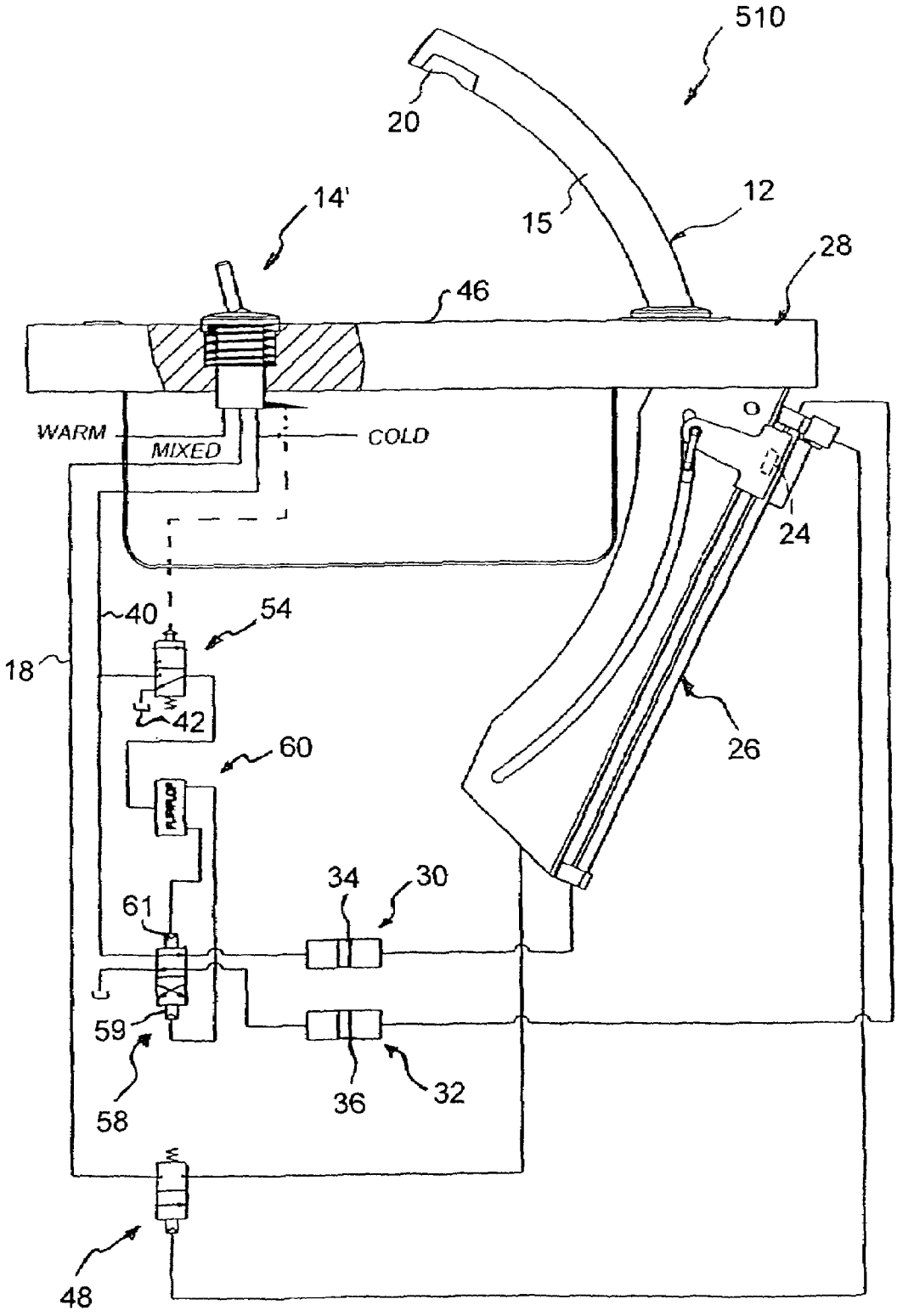
FIG. 6 is a side elevational view, in partial schematic, of a further illustrative embodiment faucet, wherein the upward and downward movement of the spout is alternately activated by momentarily depressing the control input.

As with the embodiment shown in FIGS. 4A-5B, the illustrative embodiment of faucet 510 shown in FIG. 6 is provided with an adjusting means 14' which can be depressed for activating a slide valve 54 communicating therewith. By momentarily depressing the adjusting means 14', the slide valve 54 communicating therewith causes pressure from the cold water supply 40 to be fed to an active binary flip-flop valve 60, which is known in the art and may comprise the type M/1787 from Martonair. The flip-flop valve 60 applies pressure from the cold water supply 40 alternately to the left (upper outlet in FIG. 6) or to the right (lower outlet in FIG. 6). If the flip-flop valve 60 applies the pressure to the left, the cold water pressure is fed to a subjacent change-over valve 58 for acting on the lowermost control inlet 59 thereof such that oil pressure is applied to the uppermost portion of the hydraulic cylinder 26, which then moves the piston 24 and thus the associated spout 12 downwards. By subsequently momentarily depressing the adjusting means 14', the reverse action takes place. More particularly, the subsequent activation of the flip-flop valve 60 results in pressure from the cold water supply 40 being applied to the right (lower outlet in FIG. 6). The cold water pressure is supplied to the uppermost control inlet 61 of the change-over valve 58, such that oil pressure is applied to the lowermost portion of the hydraulic cylinder 26, which then moves the piston 24 and the spout 12 upwards.

Figure 9:
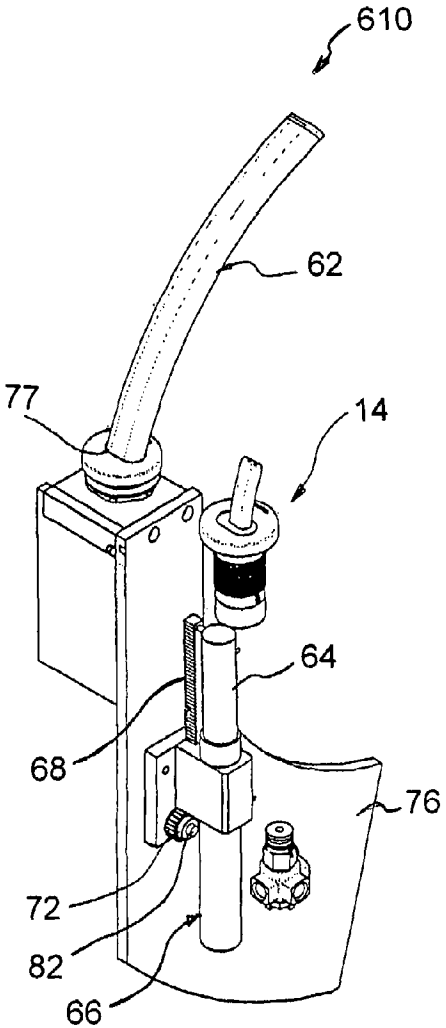
FIG. 9 is a left side perspective view of the faucet of FIG. 7, showing the spout in a raised position.
Figure 8:
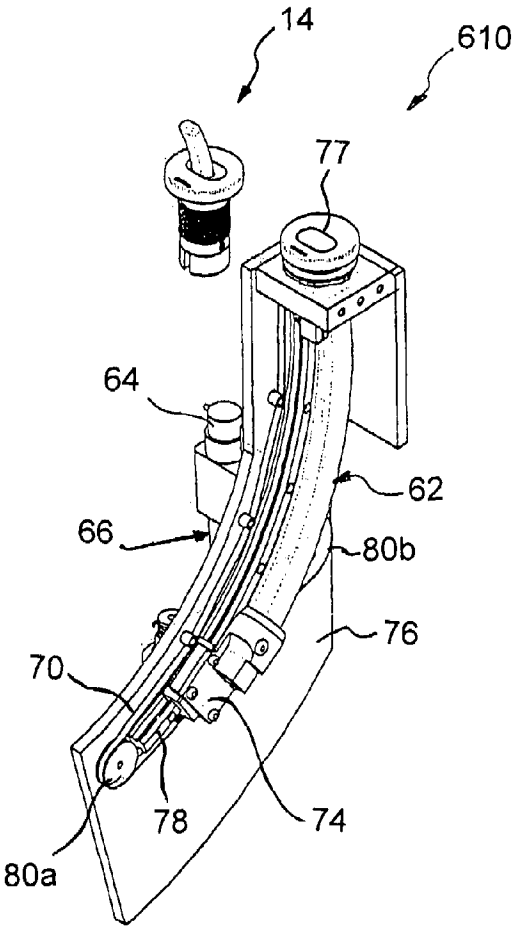
FIG. 8 is a right side perspective view of the faucet of FIG. 7, showing the spout in a lowered position.
Figure 7:
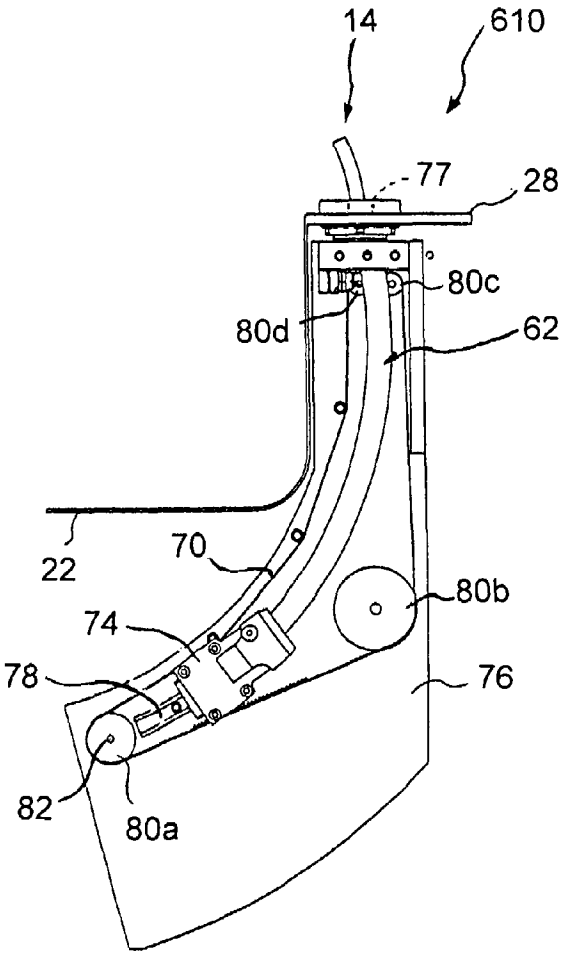
FIG. 7 is a side elevational view of a further illustrative embodiment faucet.

A further alternative embodiment of the faucet 610 according to the invention is shown in FIGS. 7, 8 and 9. As with the faucet shown in FIGS. 1A-6, the faucet 610 is provided with a spout 62, which can be moved upwards and downwards. As with the spout 12 shown in FIGS. 1A-6, the spout 62 is shaped as a circular arc and moved upwards and downwards by an actuator, illustratively a piston 64 of a hydraulic cylinder 66. However, in the embodiment shown in FIGS. 7-9, a toothed rack 68 is inserted between the piston 64 and the displaceable spout 62. The rack 68 is configured to drive a toothed belt 70 via a gear wheel 72. The toothed belt 70 is operably coupled to a slide 74 which is supported by the lower end of the spout 62. As a result, action of the piston 64 will cause the spout 62 to be moved either upwards or downwards.

A bracket 76 supports the spout 62 and the hydraulic cylinder 66. On one side of the bracket 76, the movable spout 62 is configured to extend upwardly through an opening 77 in a plane substantially flush with the upper surface 46 of the support deck 28, for instance a kitchen countertop (FIG. 7). At the lower end, the spout 62 is secured to the slide 74, which may slide along a circular track 78 behind the spout 62. The toothed belt 70, which is guided by a number of wheels 80, is secured to the movable slide 74. Movement of the toothed belt 70 thus causes the slide 74 to be moved either upwards or downwards along the circular track 78. Via a shaft 82 extending through the bracket 76, one of the wheels 80*a* is connected to the gear wheel 72 meshing with the toothed rack 68 on the other side of the bracket 76 (FIGS. 7 and 9). The toothed rack 68 is fixedly connected with the piston rod 64 and is upwardly movable dependent on the pressure of a fluid applied to the piston rod 64.

Figure 10:
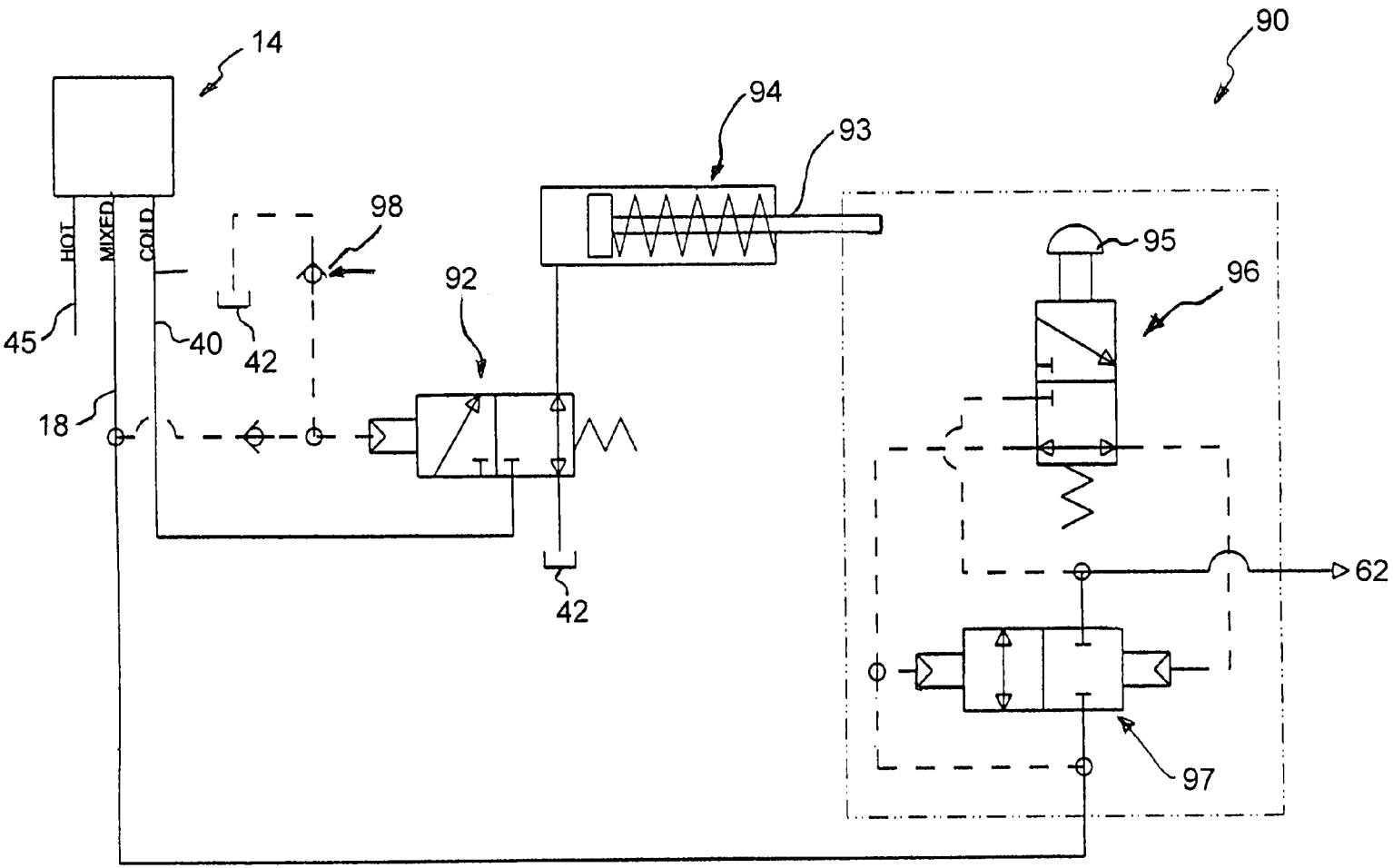
FIG. 10 is a schematic view of an illustrative embodiment hydraulic control circuit for use with the faucet of FIG. 7.

FIG. 10 shows an illustrative embodiment hydraulic control circuit 90 associated with the faucet 610. On the left-hand side of FIG. 10, the cold water supply 40, the hot water supply 45, and the mixed water supply 18, respectively, are shown. When the mixed water supply 18 is turned on, a slide valve 92 is effected such that the pressure from the cold water supply 40 is exerted on the piston rod 93 of a cylinder 94 which thereby moves to the right in FIG. 10. When the piston rod 93 reaches an outer position, a pushbutton 95 of a slide valve 96 is activated and is thus displaced in a downward direction. The water pressure being supplied to the right side of a subjacent slide valve 97 thus decreases, whereby the slide valve 97 is displaced to the right such that passage for the mixed water supply 18 to the discharge spout 62 is provided.

A special release valve 98 is further provided which is configured to be activated when the spout 62 is to be moved downwards. More particularly, activation of the release valve 98 causes the slide valve 92 to return to its neutral position (to the left in FIG. 10), which in turn causes the pushbutton 95 of the slide valve 96 to be deactivated. As a result, the slide valve 96 returns to its neutral position (upward in FIG. 10), whereby the slide valve 97 is displaced to the left such that the mixed water supply 18 is disconnected from the spout 62.

Optionally, a cover may be provided over the opening of the discharge spout 62 such that the entire arrangement becomes more discrete, and optionally such that the control unit per se is not visible.

In all of the shown embodiments, the spout 12, 62 may be pivotal in its uppermost or raised position for convenient positioning relative to the sink 22. More particularly, the spout 12, 62 may pivot about a substantially vertical axis for positioning of the outlet 20 above the sink 22.

The faucet according to the invention is not intended for kitchen sinks only. It may also be used in connection with a washbasin (basin), a bathtub or a bidet, and optionally also in a shower. Further, while the illustrative embodiment faucet may be controlled by hydraulics, such as the hydraulic control circuit 90 of FIG. 10, the faucet may also be electronically controlled.

Although the invention has been described in detail with reference to certain preferred embodiments, variations and modifications exist within the spirit and scope of the invention as described and defined in the following claims.

The invention claimed is:

1. A faucet for use with a support deck having a basin associated therewith, the faucet comprising:

a vertically movable delivery spout; and an actuator operably coupled to the delivery spout and configured to move the delivery spout between a raised position above an upper surface of the support deck and over a bottom surface of the basin of the support deck and a lowered position, the delivery spout being positioned outside of the basin in the lowered position.

2. The faucet of claim 1, further comprising a guide operably coupled to the delivery spout and configured to guide the delivery spout in movement between the raised position and the lowered position.

3. The faucet of claim 2, further comprising:

a valve configured to control water flow from the water supply to the outlet; and a sensor operably coupled to the valve and configured to detect when the delivery spout is in the raised position and control operation of the valve in response thereto.

4. The faucet of claim 1, further comprising a control input operably coupled to the actuator and configured to control operation of the actuator.

5. The faucet of claim 1, wherein the actuator comprises a hydraulic cylinder including a piston rod.

6. The faucet of claim 1, wherein the delivery spout is coupled to a water supply and the actuator is activated by pressure from the water supply.

7. The faucet of claim 1, wherein water is supplied from the delivery spout only when the delivery spout is in the raised position.

8. A faucet coupled to a water supply and supported by a support deck having a basin, the faucet comprising a delivery spout movable between an uppermost raised position wherein an outlet of the delivery spout is above an upper surface of the support deck and a lowered position wherein the outlet of the delivery spout is below the upper surface of the support deck, and a valve positioned outside of the basin and below the support deck, the valve operably coupled to the delivery spout and configured to provide fluid communication between the water supply and the delivery spout only when the delivery spout is in the uppermost raised position.

9. The faucet of claim 8, further comprising an actuator coupled to the spout and configured to move the spout between the raised position and the lowered position.

10. The faucet of claim 9, wherein the actuator is activated by pressure from the water supply.

11. The faucet of claim 9, further comprising a guide operably coupled to the delivery spout and configured to guide the delivery spout in movement between the raised position and the lowered position.

12. The faucet of claim 8, further comprising a sensor operably coupled to the valve and configured to detect when the delivery spout is in the raised position and control operation of the valve in response thereto.

13. A faucet configured to be supported by a support deck having an upper surface and a basin, the faucet comprising a delivery spout including a body having an outlet, the body being moveable relative to the support deck between a raised position and a lowered position, wherein the outlet of the body is supported in spaced relation above the upper surface of the support deck in the raised position for delivering water from the outlet in a downward direction to the basin and the outlet of the body is positioned below the upper surface of the support deck and outside of the basin in the lowered position.

14. The faucet of claim 13, further comprising an actuator coupled to the delivery spout and configured to move the delivery spout between the raised position and the lowered position.

15. The faucet of claim 14, wherein the delivery spout is coupled to the water supply and the actuator is activated by pressure from the water supply.

16. The faucet of claim 13, wherein water is supplied to the outlet only when the delivery spout is in the raised position.

17. The faucet of claim 16, further comprising:

a valve configured to control water flow from the water supply to the outlet; and a sensor operably coupled to the valve and configured to detect when the delivery spout is in the raised position and control operation of the valve in response thereto.

18. The faucet of claim 13, further comprising a guide operably coupled to the delivery spout and configured to guide the delivery spout in movement between the raised position and the lowered position.

19. The faucet of claim 18, wherein the guide comprises a track and a slide operably coupled to the delivery spout and configured to slidably move along the track.

20. The faucet of claim 13, further comprising a snap lock operably coupled to the delivery spout, wherein vertical movement of the spout in at least one of the directions toward the raised position and the lowered position is activated by depressing the end of the spout and releasing the snap lock.

21. A faucet comprising a vertically movable spout, a hydraulic cylinder including a piston rod operably coupled to the spout, a control input operably coupled to the hydraulic cylinder, and a hydraulic control circuit adapted such that water is not turned on until the spout is in its uppermost position , wherein the spout can be moved upwards and downwards by means of the piston rod of the hydraulic cylinder; a toothed rack is inserted between the piston rod of the hydraulic cylinder and the spout, the toothed rack meshing with a gear wheel connected with a second wheel driving a belt, the belt being connected to the spout, wherein a slide valve activated by the piston rod is provided to detect when the spout is in its uppermost position.

22. A faucet supported by a support deck and in fluid communication with a water supply comprising a vertically movable spout having an outlet for delivering water provided by the water supply, a hydraulic cylinder including a piston operably coupled to the vertically movable spout, the piston being spaced apart from the vertically moveable spout, and a control input coupled to the support deck and operably coupled to the hydraulic cylinder, wherein the spout can be moved upwards and downwards with the piston of the hydraulic cylinder, wherein the upward and downward movements of the spout are controlled by the pressure from the water supply, the piston being positioned at least partially below an upper surface of the support deck.

23. The faucet according to claim 1, wherein a toothed rack is inserted between the piston of the hydraulic cylinder and the spout, the toothed rack meshing with a gear wheel connected with a second wheel driving a belt, the belt being connected to the spout.

24. The faucet according to claim 23, wherein the toothed belt is connected with the spout via a slide which is configured to slide along a track.

25. The faucet according to claim 23, further comprising a hydraulic control circuit adapted such that water is not turned on until the spout is in its uppermost position.

26. The faucet according to claim 1, wherein the water supply to the spout is not opened until the piston is in its uppermost position.

27. The faucet according to claim 1, wherein the piston is controlled by the pressure from the water supply.

28. The faucet according to claim 1, wherein the upward movement of the piston rod is activated by depressing the end of the spout and releasing a snap lock.

29. The faucet according to claim 1, wherein the downward movement of the piston rod is activated by depressing and keeping the control input down until the spout has adopted its lowered position.

30. The faucet according to claim 1, wherein the upward and downward movement of the spout is activated alternately by momentarily depressing the control input.

31. The faucet of claim 1, wherein the piston is completely positioned below the upper surface of the support deck.

32. A faucet coupled to a water supply and supported by a support deck having a basin, the faucet comprising:

a delivery spout having an outlet positioned proximate to a first end of the delivery spout, the delivery spout being movable between a raised position wherein outlet of the delivery spout is positioned above an upper surface of the support deck and over a bottom surface of the basin of the support deck and a lowered position wherein the outlet of the delivery spout is positioned below the upper surface of the support deck and outside of the basin of the support deck;

an actuator to move the delivery spout from the lowered position to the raised position;

a control input spaced apart from the delivery spout; and a control circuit configured to control the operation of the actuator to move the delivery spout from the lowered position to the raised position.

33. The faucet of claim 32, wherein the control circuit is hydraulic control circuit.

34. The faucet of claim 32, wherein the control input is supported by the support deck.

35. The faucet of claim 32, wherein the outlet is hidden from above the support deck in the lowered position.

* * * * *

UNITED STATES PATENT AND TRADEMARK OFFICE

CERTIFICATE OF CORRECTION

PATENT NO. : 7,389,796 B2
APPLICATION NO. : 11/056720
DATED : June 24, 2008
INVENTOR(S) : Ejvind Vilhelmsen It is certified that error appears in the above-identified patent and that said Letters Patent is hereby corrected as shown below:

Col. 8, Ln. 3 in claim 23, reference to “claim 1” should be --claim 22--;
Col. 8, Ln. 16 in claim 26, reference to “claim 1” should be --claim 22--;
Col. 8, Ln. 19 in claim 27, reference to “claim 1” should be --claim 22--;
Col. 8, Ln. 21 in claim 28, reference to “claim 1” should be --claim 22--;
Col. 8, Ln. 24 in claim 29, reference to “claim 1” should be --claim 22--;
Col. 8, Ln. 28 in claim 30, reference to “claim 1” should be --claim 22--; and
Col. 8, Ln. 31 in claim 31, reference to “claim 1” should be --claim 22--.

Signed and Sealed this

Twentieth Day of January, 2009

JON W. DUDAS
*Director of the United States Patent and Trademark Office*